US010086976B2

(12) United States Patent
Tuan

(10) Patent No.: US 10,086,976 B2
(45) Date of Patent: Oct. 2, 2018

(54) CUSHION CASE FOR A CONTAINER

(71) Applicant: Ronald Tuan, Nantou County (TW)

(72) Inventor: Ronald Tuan, Nantou County (TW)

( * ) Notice: Subject to any disclaimer, the term of this patent is extended or adjusted under 35 U.S.C. 154(b) by 562 days.

(21) Appl. No.: 14/599,874

(22) Filed: Jan. 19, 2015

(65) Prior Publication Data

US 2016/0207678 A1 Jul. 21, 2016

(51) Int. Cl.

| | |
|---|---|
| ***A47G 23/03*** | (2006.01) |
| ***A47B 97/00*** | (2006.01) |
| ***B65D 25/24*** | (2006.01) |
| ***B65D 23/00*** | (2006.01) |

(52) U.S. Cl.

CPC ..... *B65D 25/24* (2013.01); *A47B 97/00* (2013.01); *A47G 23/03* (2013.01); *B65D 23/001* (2013.01)

(58) Field of Classification Search

CPC ..... A61J 1/16; A45F 2200/0583; B65D 81/3876; B65D 23/001; B65D 25/24; B65D 59/06; B65D 11/1826; A47G 23/03; A47G 23/02; A47G 23/0316; A47G 23/032; A47G 19/12; A47G 19/00; A47B 2097/008; A47J 27/00

USPC ..... 220/737, 694, 600, 483, 632, 17.1, 475, 220/660; 248/346.11, 309.1, 311.2, 248/346.01, 346.5, 346.03, 500; 215/393, 215/395

See application file for complete search history.

(56) References Cited

U.S. PATENT DOCUMENTS

| | | | | |
|---|---|---|---|---|
| 2,565,793 | A * | 8/1951 | Weismantel | A47G 29/093 220/630 |
| 2,990,968 | A * | 7/1961 | Pirman | A47G 23/03 215/393 |
| 3,038,512 | A * | 6/1962 | Staton | A01G 1/08 220/660 |
| 3,999,261 | A * | 12/1976 | Bingaman | A47G 23/02 24/530 |
| 5,467,891 | A * | 11/1995 | Perry | B65D 81/3886 220/62.11 |
| 5,961,086 | A * | 10/1999 | Moore | B01L 9/06 248/314 |
| 6,055,773 | A * | 5/2000 | Yang | A01G 9/02 119/61.1 |
| 7,712,625 | B2 * | 5/2010 | Alger | F25D 3/08 220/666 |

(Continued)

FOREIGN PATENT DOCUMENTS

| | | |
|---|---|---|
| JP | 3-17040 | 2/1991 |
| JP | 7-20940 | 4/1995 |

(Continued)

*Primary Examiner* — Coris Fung
*Assistant Examiner* — Julius Fitzhugh
(74) *Attorney, Agent, or Firm* — Ming Chow; Sinorica LLC

(57) ABSTRACT

A cushion case for a container includes an abutment portion and a supporting portion. The abutment portion is annular and has an inner surface. The supporting portion inclinedly connected with the inner surface of the abutment portion, formed as a ring-shaped and has an inner edge and an inclined surface. The cushion case can be mounted on a bottom edge of a container, which protects the bottom edge of the container or supports the container fixed on a desk to reduce loss when the container falling down by accident.

14 Claims, 11 Drawing Sheets

(56) References Cited

U.S. PATENT DOCUMENTS

| | | | | |
|---|---|---|---|---|
| 2002/0079417 | A1* | 6/2002 | Rousselet | B65D 25/24<br>248/346.01 |
| 2010/0108544 | A1* | 5/2010 | Biundo | B65D 5/28<br>206/144 |
| 2012/0228318 | A1* | 9/2012 | Martin | A47G 23/0216<br>220/739 |

FOREIGN PATENT DOCUMENTS

| | | |
|---|---|---|
| JP | 8-310561 | 11/1996 |
| JP | 2005-263249 | 9/2005 |
| KR | 20-0365786 | 10/2004 |
| TW | M475231 U | 4/2014 |

* cited by examiner

CUSHION CASE FOR A CONTAINER

BACKGROUND OF THE INVENTION

1. Field of the Invention

The present invention relates to a case for a container, and more particularly to a cushion case for a container.

2. Description of Related Art

A conventional container, such as a vacuum flask or a mug is usually placed on a desk or a table when in use and without any protection. Thus, the container may easily fall down on the desk, the table or the ground in accident. When the container falls down on the ground, the bottom edge of the container is very fragile and maybe be crushed or caved by hitting on the ground, which may cause the container unable to use or damaged on the appearance of the container. When the container falls down on the desk or the table, the liquid in the container will spill out and wet the desk or the table; this may take time to clean up and is very inconvenient.

To overcome the shortcomings of the conventional container, the present invention provides a cushion case for a container to mitigate or obviate the aforementioned problems.

SUMMARY OF THE INVENTION

In order to reach the said invention objective, the present invention provides a cushion case for a container.

The cushion case is made of elasticity material and includes an abutment portion and a supporting portion. The abutment portion is annular and has an inner surface. The supporting portion inclinedly connected with the inner surface of the abutment portion, formed as a ring-shaped and has an inner edge and an inclined surface.

The cushion case can be mounted on a bottom edge of a container, which protects the bottom edge of the container or supports the container fixed on a desk to reduce loss when the container falling down by accident.

Other objects, advantages, and novel features of the invention will become more apparent from the following detailed description when taken in conjunction with the accompanying drawing.

DETAILED DESCRIPTION OF PREFERRED EMBODIMENT

Figure 1:
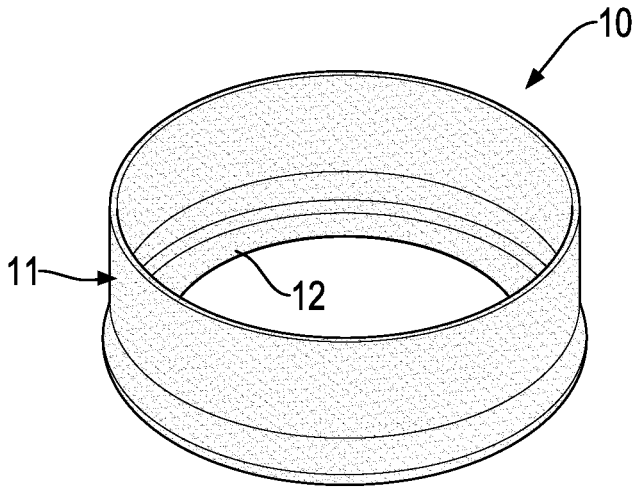
FIG. 1 is a perspective view in a first phase of a first embodiment of a cushion case for a container in accordance with the present invention.
Figure 2A:
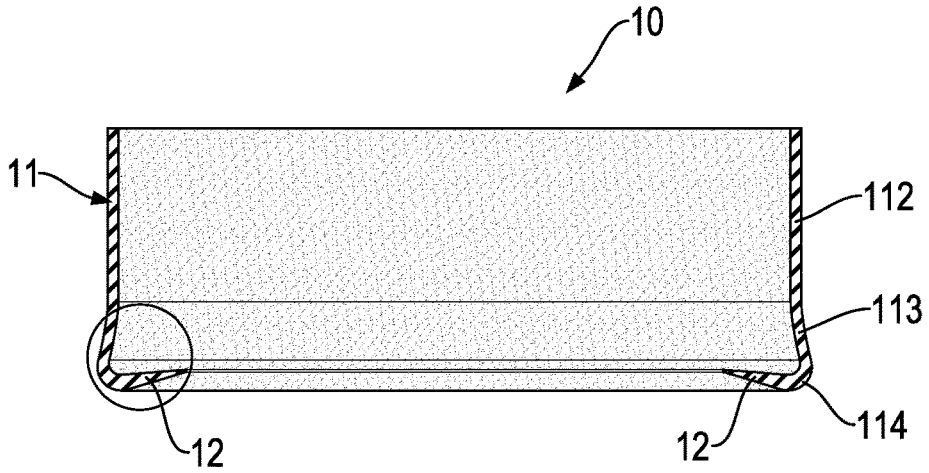
FIG. 2A is a cross-sectional side view of a first operational phase of the first embodiment of the cushion case in FIG. 1.
Figure 2B:
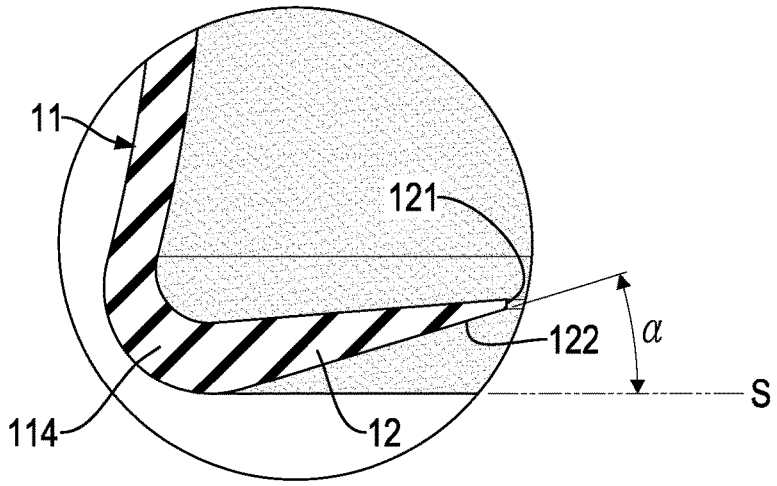
FIG. 2B is an enlarged cross-sectional side view of the first embodiment of the cushion case in FIG. 2.

With reference to FIGS. 1, 2A and 2B, a first preferred embodiment of a cushion case 10 is made of elasticity material, preferably is made of silicone, and includes an abutment portion 11 and a supporting portion 12.

The abutment portion 11 is annular and has an inner surface, an outer surface, an upper segment 112, a lower segment 113 and a connecting portion 114. The inner surface and the outer surface are opposite to each other. The upper segment 112 extends longitudinally and has an identical inner diameter. The lower segment 113 is integratedly connected with the bottom of the upper segment 112. The bottom of the lower segment 113 extends outward related to the upper segment 112. The connecting portion 114 is curved and is integrally connected with the bottom of the lower segment 113. The inner diameter of the top of the connecting portion 114 is larger than that of the bottom one of the connecting portion 114.

The supporting portion 12 is inclinedly connected with the connecting portion 114 of the abutment portion 11, is formed as a ring and has an inner edge 121 an inclined surface 122. The thickness of supporting portion 12 gradually decreases from the connecting portion 114 to the inner edge 121. The inclined surface 122 is formed on the bottom of the supporting portion 12 and formed an angle $\alpha$ between the inclined surface 122 and a horizontal surface S.

Figure 3:
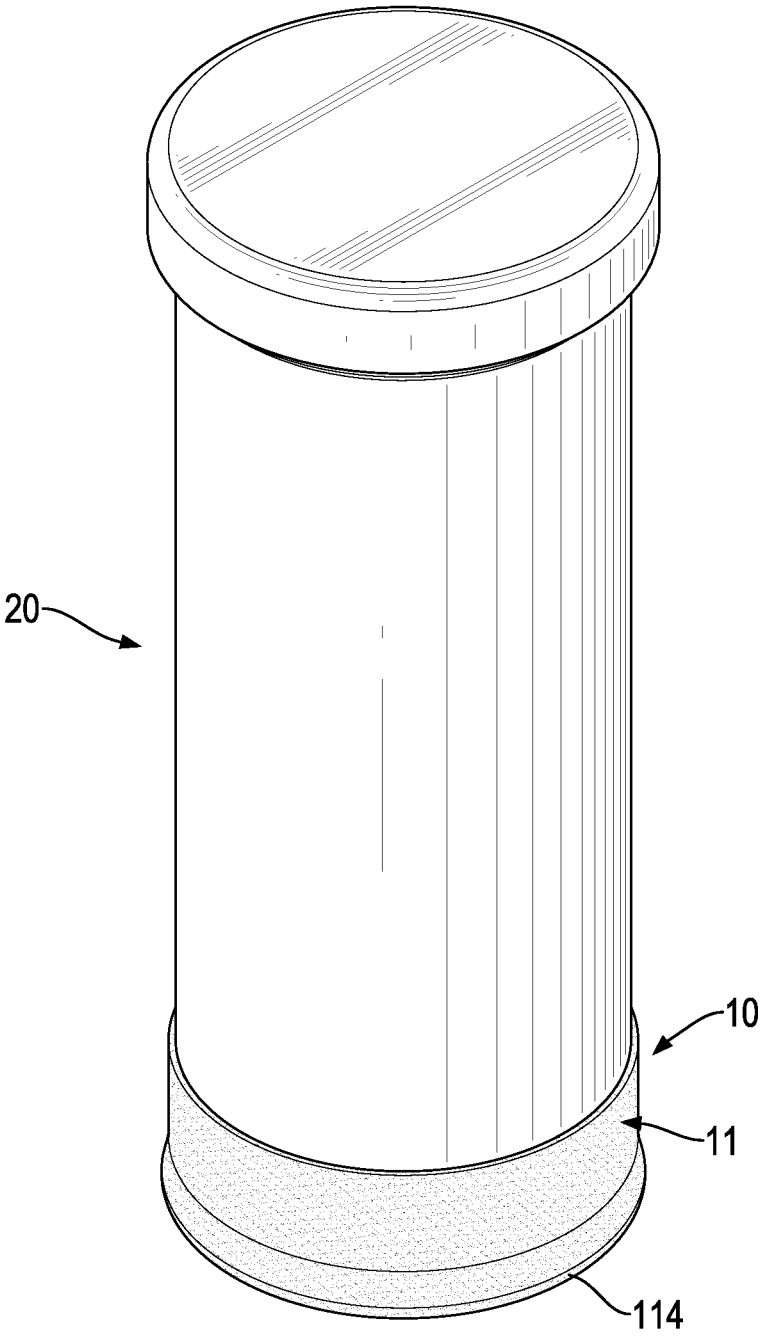
FIG. 3 shows an operational perspective view of the cushion case in FIG. 1 mounted on a bottom edge of a container.
Figure 4:
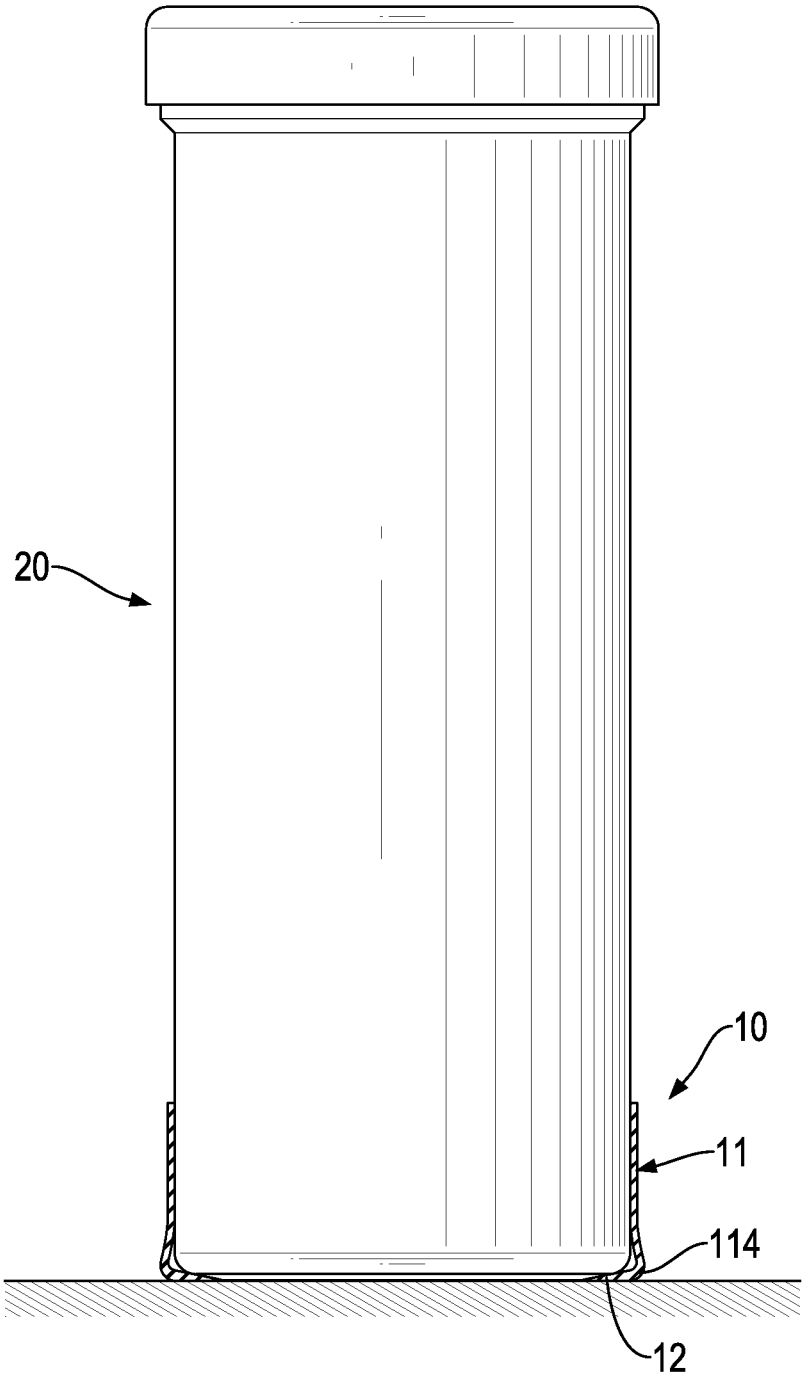
FIG. 4 is a side view in partial section of the container with the cushion case in FIG. 3.

With reference to FIGS. 3 and 4, the cushion case 10 is mounted on a bottom of a container 20. The top of the supporting portion 12 abuts the bottom of the container 20. The inner surface of the abutment portion 11 abuts an outer surface of the container 20. A gap is formed between an inner surface of the connecting portion 114 and a bottom edge of the container 20. If the container 20 falls down on the ground in accident, the cushion case 10 is elastic and a cushion effect is provided to protect the bottom edge of the container 20. Therefore, the container 20 will not be crashed or be caved by hitting the ground and be protected by the cushion case 10.

Figure 5:
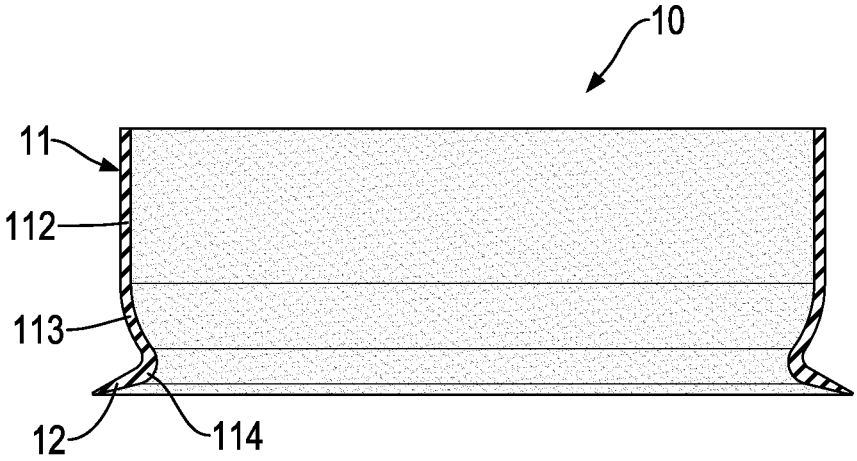
FIG. 5 is a cross-sectional side view of a second operational phase of the cushion case in FIG. 1.
Figure 6:
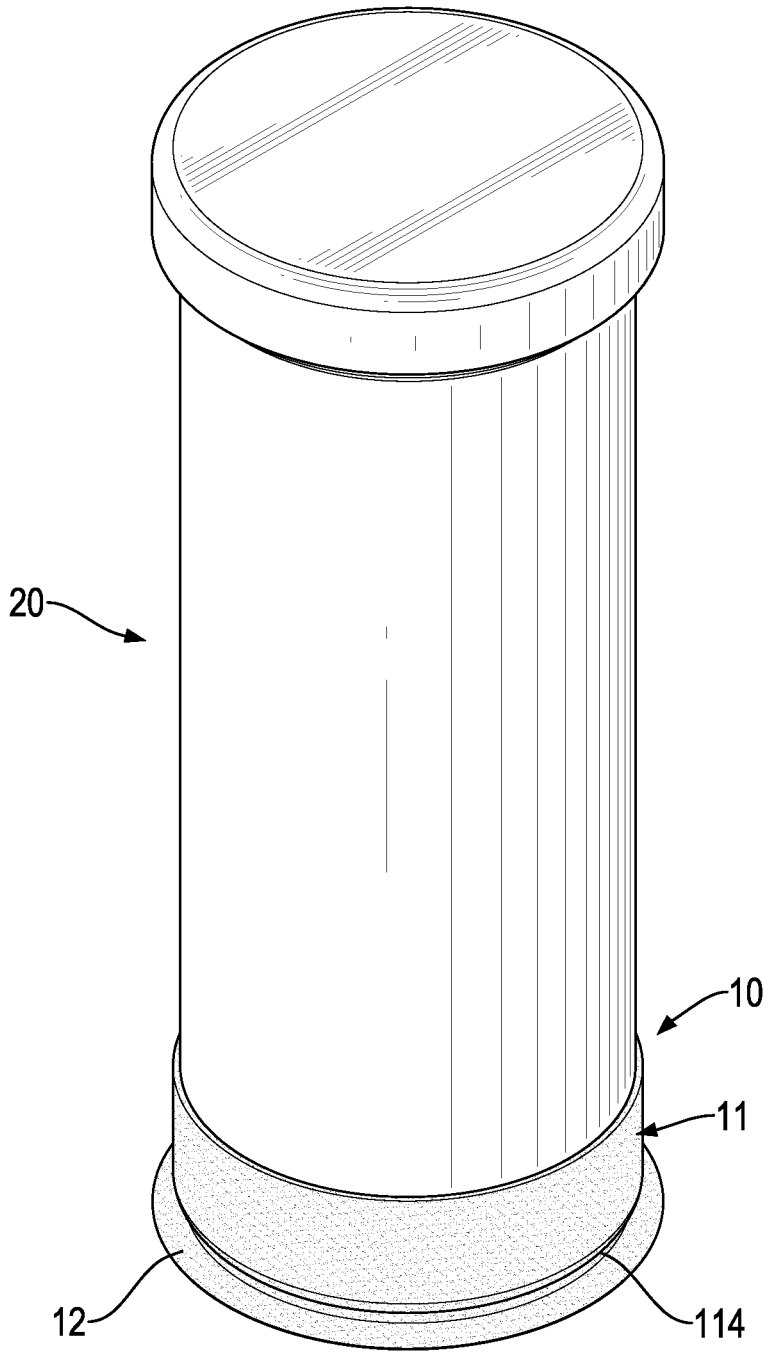
FIG. 6 shows an operational perspective view of the cushion case in FIG. 5 mounted on the bottom edge of the container.
Figure 7:
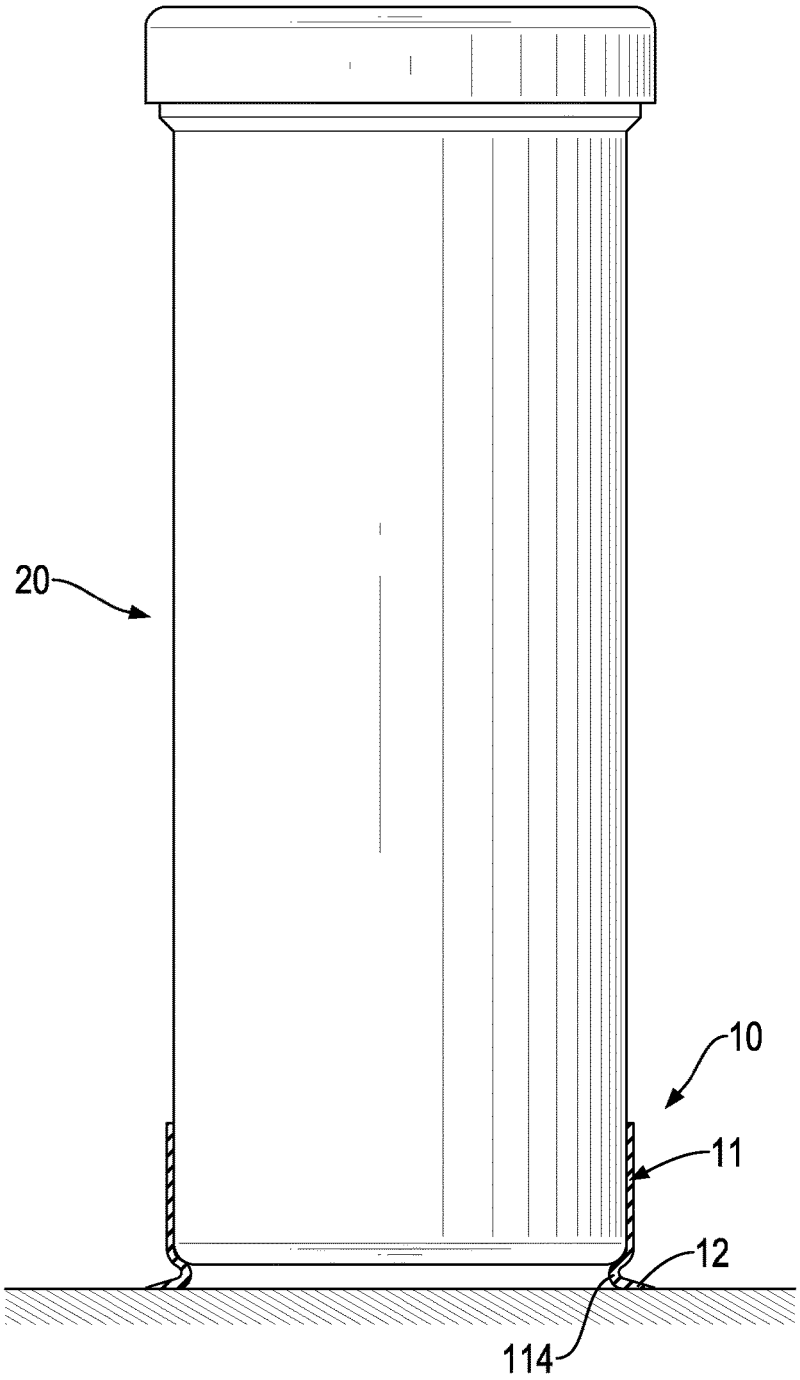
FIG. 7 is a side view in partial section of the container with the cushion case in FIG. 6.

With reference to FIGS. 5 to 7, in a second operational phase, the inner surface of the abutment portion 11 is turned over to the outer side. Thus, the lower segment 113 of the abutment portion 11 is shrank relate to the upper segment 112, and the supporting portion 12 becomes expanded from the top of the supporting portion 12 to the bottom of the supporting portion 12. When the cushion case 10 is mounted on a bottom of a container 20, the bottom of the container 20 is sleeved by the lower segment 113 of the abutment portion 11. If the container 20 is placed on a desk, and the supporting portion 12 is pressed to abut a surface of the desk or the table. Because a space is formed between the supporting portion 12, the bottom of the container 20 and the surface of the desk, when the supporting portion 12 is pressed, air is discharged out from the space, and make the supporting portion 12 adhered to the surface of the desk by suction effect. Therefore, if the container 20 falls down on the desk in accident, the supporting portion 12 can absorb the impact and supports the container 20 not to fall down.

Figure 8:
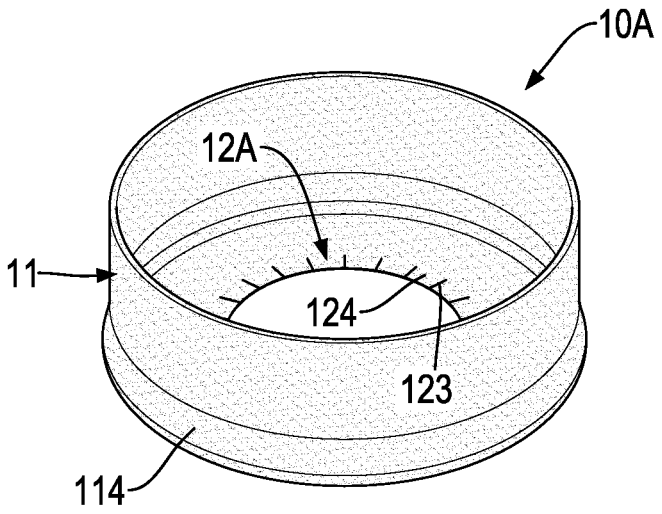
FIG. 8 is a perspective view of a second embodiment of a first operational phase of a cushion case for a container in accordance with the present invention.

With reference to FIG. 8, in a second preferred embodiment of the cushion case in accordance with the present invention, the elements and effects of the second embodiment are same as those of the first embodiment except the shape of the supporting portion 12A of the cushion case 10A.

The supporting portion 12A further includes multiple cutting lines 123 and multiple grabbing portions 124. The cutting lines 123 are arranged along the inner edge 121 of the supporting portion 12A. The grabbing portions 124 are formed respectively between the cutting lines 123.

The operational way of the first phase of the second preferred embodiment is same as that of the first phase of the first preferred embodiment, and the operational way of the second phase of the second preferred embodiment is similar to that of the second phase of the first preferred embodiment.

Figure 9:
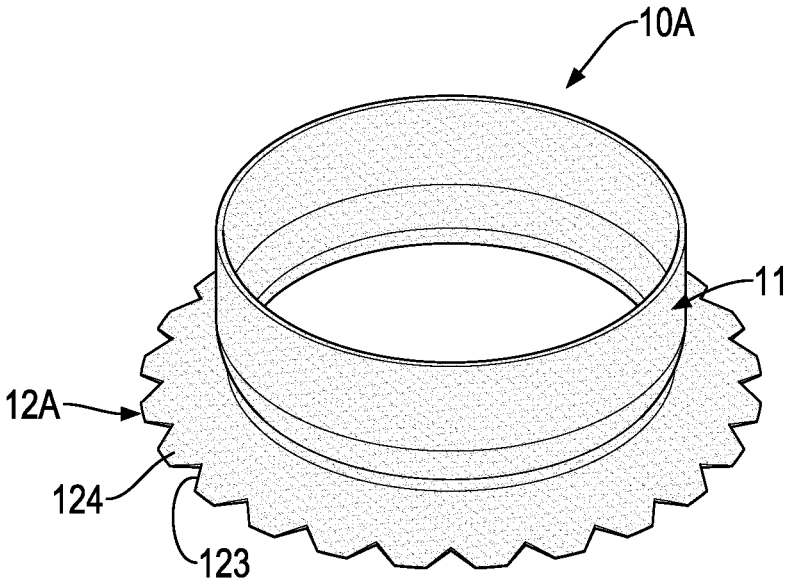
FIG. 9 is a perspective side view of a second operational phase of the cushion case in FIG. 8.
Figure 10:
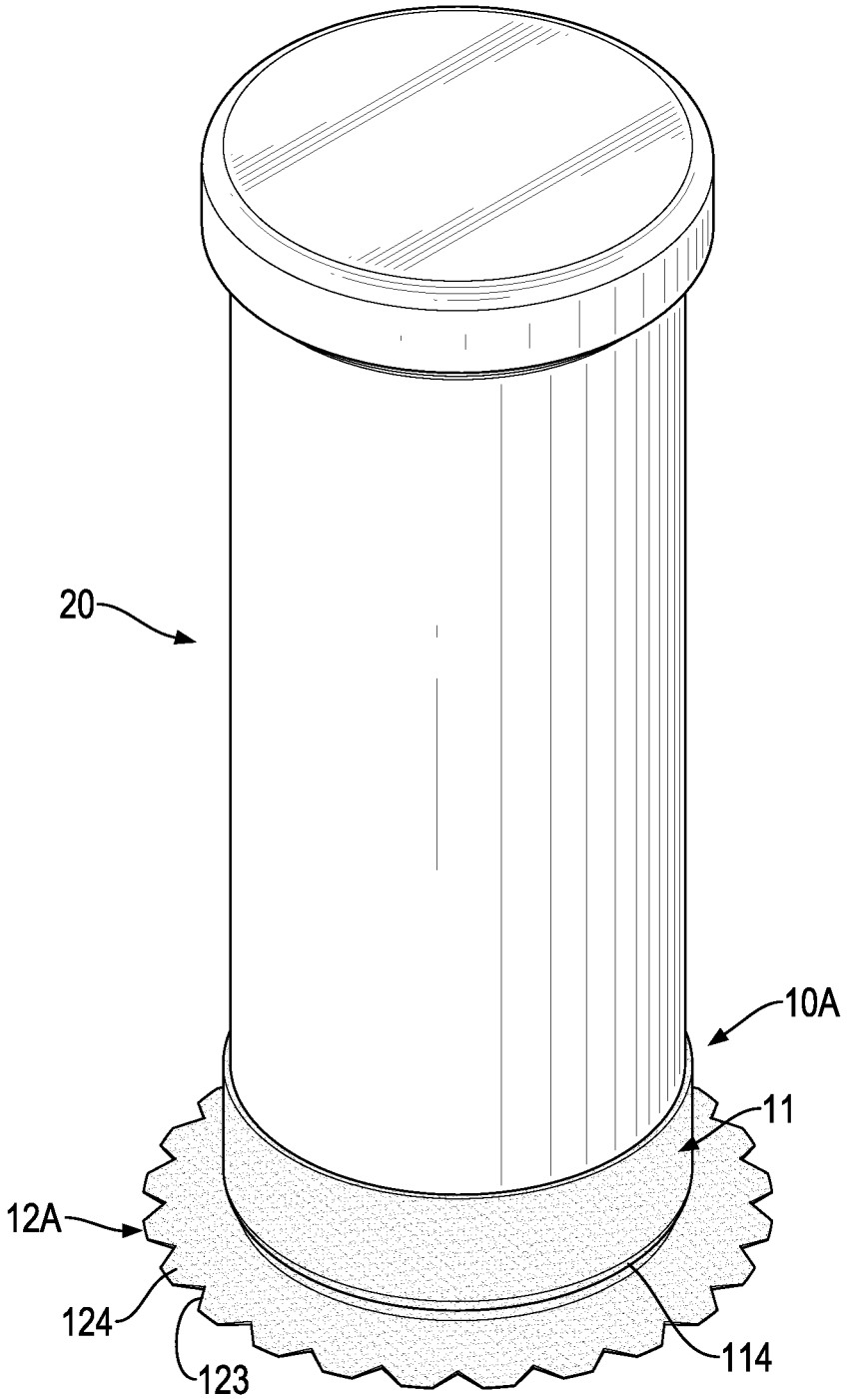
FIG. 10 shows an operational perspective view of the cushion case in FIG. 9 mounted on the bottom edge of the container.

With the reference of FIGS. 9 and 10, in the second operational phase, the supporting portion 12A is spread out and the inner edge 121 is turned over to the outer side. Because the supporting portion 12A has cutting lines 123 and the grabbing portions 124, the inner edge 121 becomes gear-shaped. Thus, the contact area of the supporting portion 12A is increased to adhere to the surface of the desk firmly.

Figure 11:
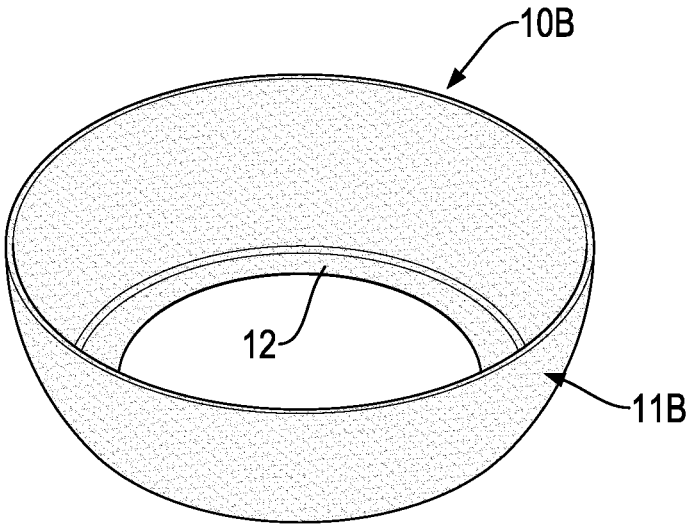
FIG. 11 is a perspective view of a third embodiment of a cushion case for a container in accordance with the present invention.

With reference to FIG. 11, in a third preferred embodiment of the cushion case in accordance with the present invention, the elements and effects of the second embodiment are same as those of the first embodiment except the shape of the abutment portion 11B of the cushion case 10B.

The abutment portion 11B is curved in longitudinal cross-section. The inner diameter of the abutment portion 11B is gradually expanded from the bottom to the top, and the top of the inner diameter of the abutment portion 11B is greater than the bottom one.

The cushion case 10B is suitable for using on a bowl-shaped container. The cushion case 10B is firmly mounted on the bowl-shaped container because the shaped of the abutment portion 11B of the cushion case 10B fits the bottom edge of the bowl-shaped container, which reduces the possibility of the cushion case 10B dropping off from the bowl-shaped container.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cushion case for a beverage container comprising:

an abutment portion being annular and having an inner surface; and a supporting portion formed on a bottom edge of the abutment portion, inclinedly connected with the inner surface of the abutment portion, formed in a ring shape, and having an inner edge being higher than a bottom of the abutment portion; and an inclined surface formed on a bottom of the supporting portion, and an angle formed between the inclined surface and a horizontal surface, the angle being greater than 0 degree;

the cushion case is made of an elastomeric material and the inner surface of the abutment portion is capable of being turned over to an outer side to change an operation phase; and the supporting portion becomes expanded outward relative to the abutment portion and from a top of the supporting portion to the bottom of the supporting portion after the inner surface of the abutment portion is turned over to the outer side.

2. The cushion case as claimed in claim 1, wherein the abutment portion has an upper segment;

a lower segment integratedly connected with a bottom of the upper segment; and a connecting portion being arc-shaped and integratedly connected with a bottom of the lower segment, an inner diameter of a top of the connecting portion being larger than an inner diameter of a bottom of the connecting portion.

3. The cushion case as claimed in claim 2, wherein the thickness of the supporting portion gradually decreases from the connecting portion to the inner edge of the supporting portion.

4. The cushion case as claimed in claim 3, wherein the upper segment of the abutment portion has an inner diameter, and the bottom of the lower segment extends outward relative to the upper segment.

5. The cushion case as claimed in claim 4, wherein the cushion case is made of silicone, and the supporting portion is integratedly connected with the abutment portion.

6. The cushion case as claimed in claim 5, wherein the supporting portion further includes multiple cutting lines arranged along the inner edge of the supporting portion; and multiple grabbing portions each formed between two adjacent said cutting lines.

7. The cushion case as claimed in claim 4, wherein the supporting portion further includes multiple cutting lines arranged along the inner edge of the supporting portion; and multiple grabbing portions each formed between two adjacent said cutting lines.

8. The cushion case as claimed in claim 3, wherein the supporting portion further includes multiple cutting lines arranged along the inner edge of the supporting portion; and multiple grabbing portions each formed between two adjacent said cutting lines.

9. The cushion case as claimed in claim 2, wherein the supporting portion further includes multiple cutting lines arranged along the inner edge of the supporting portion; and multiple grabbing portions each formed between two adjacent said cutting lines.

10. The cushion case as claimed in claim 2, wherein the abutment portion is curved in longitudinal cross-section of the abutment portion, the inner diameter of the abutment portion is gradually expanded from the bottom to the top, and the inner diameter at the top of the abutment portion is greater than the inner diameter at the bottom of the abutment portion.

11. The cushion case as claimed in claim 10, wherein the thickness of the supporting portion gradually decreases from the connecting portion to the inner edge of the supporting portion.

12. The cushion case as claimed in claim 11, wherein the cushion case is made of silicone, and the supporting portion is integratedly connected with the abutment portion.

13. The cushion case as claimed in claim 10, wherein the cushion case is made of silicone, and the supporting portion is integratedly connected with the abutment portion.

14. The cushion case as claimed in claim 1, wherein the supporting portion further includes multiple cutting lines arranged along the inner edge of the supporting portion; and multiple grabbing portions each formed between two adjacent said cutting lines.

* * * * *